US008726533B2

(12) United States Patent
Cai et al.

(10) Patent No.: US 8,726,533 B2
(45) Date of Patent: May 20, 2014

(54) OVER DEVICE OF TUNNEL-TYPE STERILIZATION DRYER

(75) Inventors: Dayu Cai, Changsha (CN); Zhigao Ning, Changsha (CN); Bo Yi, Changsha (CN); Zanming Zhu, Changsha (CN); Zhen Liu, Changsha (CN); Yue Tang, Changsha (CN)

(73) Assignee: Truking Technology Limited, Changsha, Hunan (CN)

( * ) Notice: Subject to any disclaimer, the term of this patent is extended or adjusted under 35 U.S.C. 154(b) by 239 days.

(21) Appl. No.: 13/395,449

(22) PCT Filed: Jun. 24, 2010

(86) PCT No.: PCT/CN2010/074422

§ 371 (c)(1),
(2), (4) Date: Apr. 16, 2012

(87) PCT Pub. No.: WO2011/047555

PCT Pub. Date: Apr. 28, 2011

(65) Prior Publication Data

US 2012/0216417 A1 Aug. 30, 2012

(30) Foreign Application Priority Data

Oct. 23, 2009 (CN) ..... 2009 2 0313218 U

(51) Int. Cl.
*F26B 15/08* (2006.01)

(52) U.S. Cl.
USPC ..... 34/165; 34/173; 34/212; 110/233; 438/5; 219/391

(58) Field of Classification Search
USPC ..... 34/165, 168, 171, 173, 212, 216; 219/391; 134/26; 206/216; 222/1; 438/1, 5; 110/341, 233
See application file for complete search history.

(56) References Cited

U.S. PATENT DOCUMENTS 1,681,145 A * 8/1928 Parker ..... 34/437
2,779,102 A * 1/1957 Baker ..... 34/60

(Continued)

FOREIGN PATENT DOCUMENTS

GB 1379370 A * 9/1975
WO WO 2011047555 A1 * 4/2011

*Primary Examiner* — Steve M Gravini
(74) *Attorney, Agent, or Firm* — Raymond Y. Chan; David and Raymond Patent Firm

(57) ABSTRACT

An baking case body of tunnel type sterilization dryer comprises a case body (1), an air intake cavity (24) which is disposed in the case body (1), a conveyor mesh belt (7), and an air return channel (22). The conveyor mesh belt (7) is located between the air return channel (22) and the air intake cavity (24). The air intake cavity (24) is divided into two or more than two independent air intake chambers (21) by one or more than one air intake partition boards (11). A heater (9) is disposed in each air intake chamber (21), and a hot air generator (2), a diffuser fan cover (3), a high temperature and high efficient filter (4) and a temperature probe (5) are disposed sequentially in each air intake chamber (21) from top to bottom. Air return partition boards (15) are arranged in the air return channel (22), corresponding to the air intake partition boards (11). The air return channel (22) is divided into two or more than two air return cavities (23) by the air return partition boards (15). The exit end of the air return cavity (23) is located at the bottom of the heater (9). The structure of the baking case body of tunnel type sterilization dryer is simple and compact, and the uniformity of the hot air is good.

4 Claims, 3 Drawing Sheets

(56) References Cited

U.S. PATENT DOCUMENTS

| | | | | | |
|---|---|---|---|---|---|
| 3,161,483 | A * | 12/1964 | Morris | 34/580 |
| 3,217,425 | A * | 11/1965 | Nikkel | 34/556 |
| 3,623,235 | A * | 11/1971 | Smith, Jr. | 4/273 |
| 3,831,535 | A * | 8/1974 | Baardson | 110/186 |
| 4,104,804 | A * | 8/1978 | Sargeant | 34/262 |
| 5,199,354 | A * | 4/1993 | Wood | 110/241 |
| 5,375,344 | A * | 12/1994 | Ruefli et al. | 34/269 |
| 5,832,627 | A * | 11/1998 | Hiebert | 34/580 |
| 5,937,535 | A * | 8/1999 | Hoffman et al. | 34/78 |
| 6,195,908 | B1 * | 3/2001 | Crul | 34/343 |
| 6,688,018 | B2 * | 2/2004 | Soucy | 34/68 |
| 7,404,262 | B2 * | 7/2008 | Jurkovich et al. | 34/381 |
| 7,730,633 | B2 * | 6/2010 | Jurkovich et al. | 34/381 |
| 2003/0196346 | A1 * | 10/2003 | Schmidt | 34/236 |
| 2004/0000069 | A1 * | 1/2004 | Gurol | 34/592 |
| 2005/0274035 | A1 * | 12/2005 | Beal et al. | 34/63 |
| 2010/0223804 | A1 * | 9/2010 | Flaherty et al. | 34/279 |
| 2012/0097607 | A1 * | 4/2012 | Merai | 210/609 |
| 2012/0168424 | A1 * | 7/2012 | Cai et al. | 219/391 |
| 2012/0216417 | A1 * | 8/2012 | Cai et al. | 34/212 |
| 2013/0047458 | A1 * | 2/2013 | Bero et al. | 34/370 |
| 2013/0145646 | A1 * | 6/2013 | Wolowiecki | 34/491 |
| 2013/0176401 | A1 * | 7/2013 | Monari et al. | 348/47 |

* cited by examiner

OVER DEVICE OF TUNNEL-TYPE STERILIZATION DRYER

BACKGROUND OF THE PRESENT INVENTION

1. Field of Invention

The present invention relates to a machinery for packaging which is used in food and pharmaceutical industries, and more particularly to a sterilizer and dryer device for food and pharmaceutical industries.

2. Description of Related Arts

In food and pharmaceutical packaging machinery industries, uniformity of heat to flow is an important index for research in sterilizer and dryer device which utilizes circulating hot air. The heating principle is carrying out heat exchange through a heater and a circulating air flow. The circulating air is first heated by the heater, guided to flow into a wind shield and to a high temperature high efficiency filter device, and then having heat exchange with food or pharmaceutical bottle. Generally, the control method includes one temperature probe positioned in the middle of a heating chamber of the oven which is used as the point of control to detect the temperature of air flow at a lower level of the heating chamber and to provide a feedback to a control unit. The control unit then controls the amount of heat from the heater to control the temperature of the air flow. However, when the capacity requirement is increased, a length of the tunnel type oven is increased. Accordingly, the provision of only one point in the middle of the heating chamber fails to effectively control the temperature of the entire heating surface in the heating chamber. Therefore, problem of over-heat is common for the conventional oven. Also, temperature difference between a front and a back portion of the heating chamber not only affects the uniformity of temperature, but also has a direct impact on the functionality of the device. When the temperature is too high, parts of the heating chamber may be damaged (for example, the high temperature high efficiency filter usually has a maximum temperature threshold of operation).

SUMMARY OF THE PRESENT INVENTION

Accordingly, the present invention is to solve the technical problem of an oven device. The present invention provides an oven device of a tunnel-type sterilizer and dryer which is simple and compact in size, low in cost, suitable for applications in different areas and superior in uniformity of hot air.

Additional advantages and features of the invention will become apparent from the description which follows, and may be realized by means of the instrumentalities and combinations particular point out in the appended claims.

According to the present invention, the foregoing and other objects and advantages are attained by the followings:

A tunnel-type sterilizer and dryer oven device, which includes a case body, an air intake cavity, a conveyor belt and an air return channel provided in the case body, wherein the conveyor belt is positioned between the air return channel and the air intake cavity, the characteristics are that the oven device comprises one or more air intake partition boards in the air intake cavity to divide the air intake cavity into two or more independent air intake chambers, wherein each the air intake chamber comprises a heater, and a hot air generator, a diffuser fan cover, a high temperature high efficiency filter and a temperature probe sequentially provided from a top portion to a bottom portion of the air intake chamber, wherein an air return partition board is provided in the air return channel at a position corresponding to a position of the air intake partition board such that the air return channel is divided into two or more air return chamber, wherein an air exit end of each the air return chamber is positioned at a bottom end of the heater.

The present invention is further improved with the following features:

Each of the air return chamber comprises one or more air return chamber partition board which divides the air return chamber into two or more air return passage, wherein an exit end of each the air return passage is positioned at the bottom end of the heater.

The case body has an exterior surface and a heat retaining layer on the exterior surface of the case body, wherein the heat retaining layer has an opening serving as a supplemental air inlet.

Compared to conventional technologies, the advantageous effect of the present invention is as follows:

The tunnel-type sterilizer and dryer oven device according to the preferred embodiment of the present invention makes use of air intake partition boards in the air intake cavity of the oven device to divide the air intake cavity sequentially into independent air intake chambers, wherein each independent air intake chamber includes a heater, and a hot air generator, a diffuser fan cover, a high temperature high efficiency filter, a supplemental air inlet and a temperature probe. Therefore the elongated cavity of the oven device is divided into smaller air intake chambers and the temperature of the air flow inside the smaller chambers can be controlled through the temperature probe, the hot air generator and the heater of the air intake chamber. Accordingly, the temperature across the longitudinal axis is uniformly provided, thereby enhancing the overall uniformity of hot air while suitable for use in a variety of production line.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The tunnel-type sterilizer and dryer oven device is further described with the accompanying drawings and illustrative examples as follows.

Figure 1:
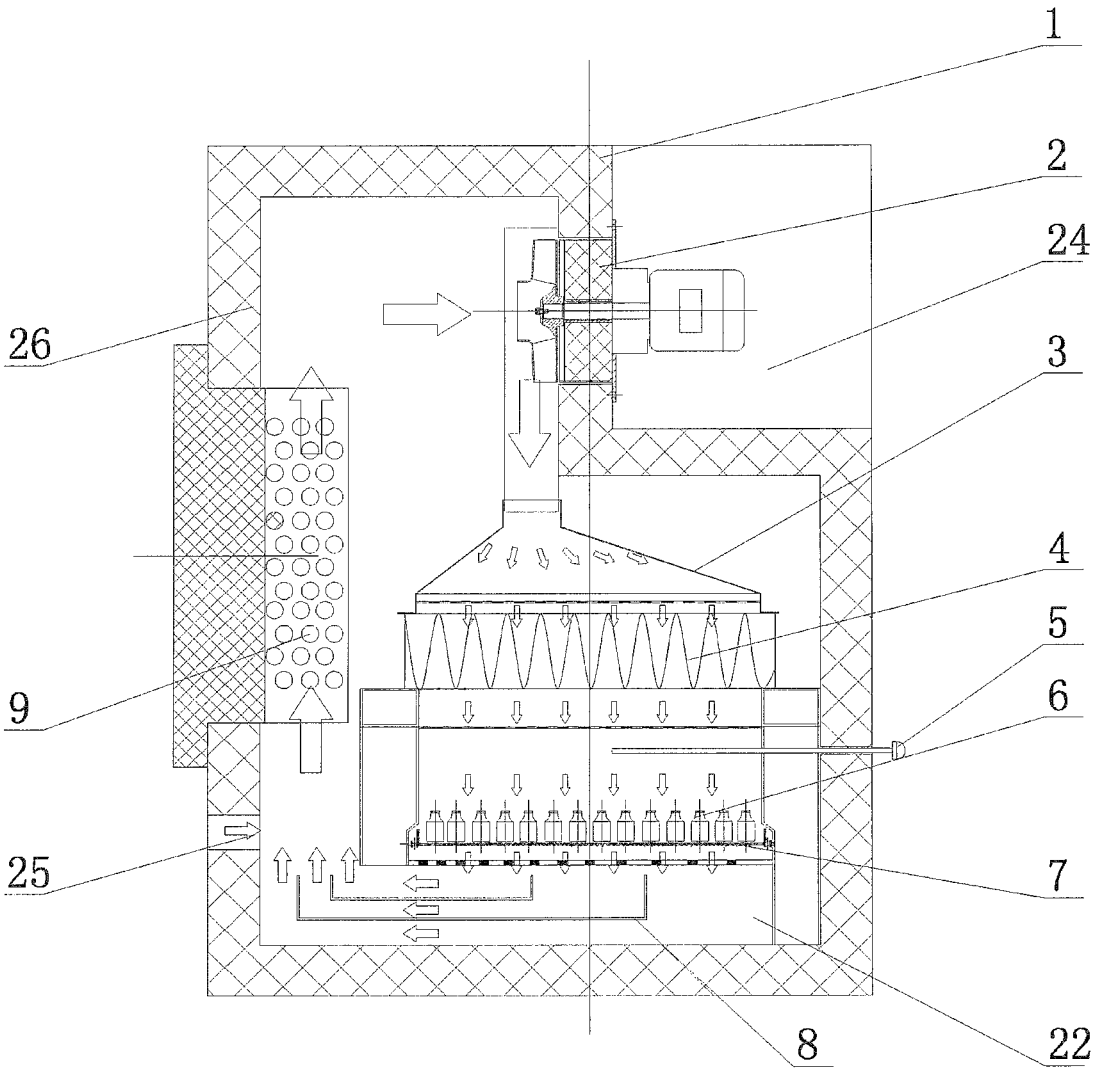
FIG. 1 is a front cross-section illustration of a tunnel-type sterilizer and dryer oven device according to a preferred embodiment of the present invention.
Figure 2:
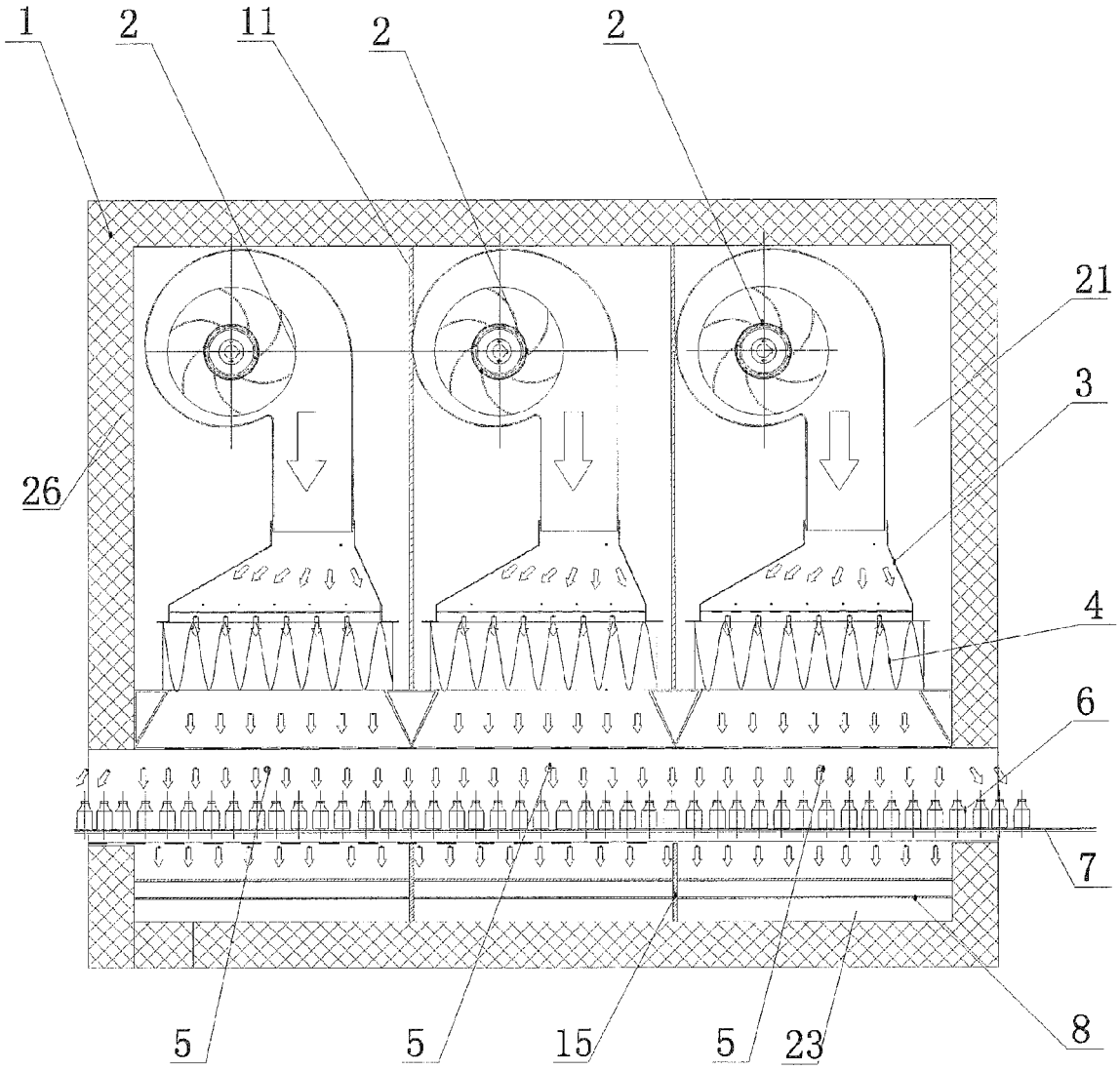
FIG. 2 is a side cross-section illustration of a tunnel-type sterilizer and dryer oven device according to the above preferred embodiment of the present invention.
Figure 3:
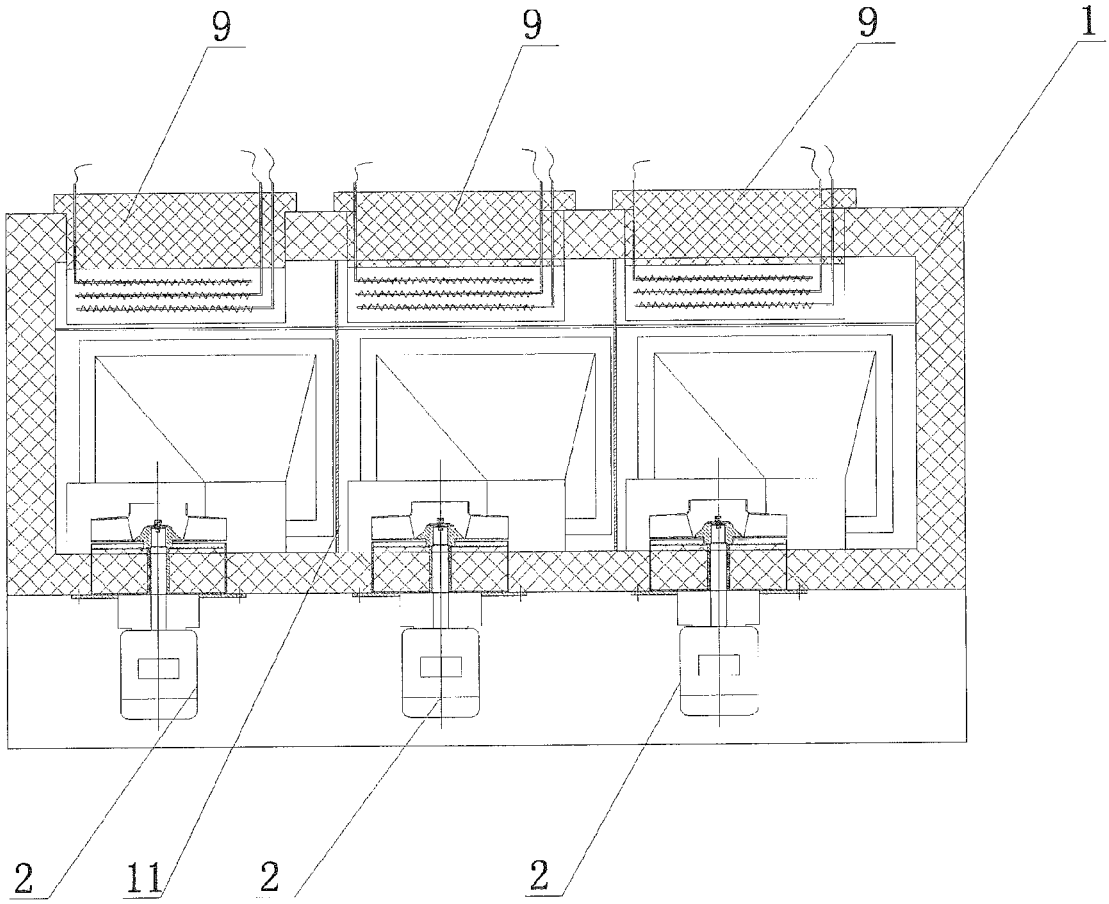
FIG. 3 is a top view illustration of a tunnel-type sterilizer and dryer oven device according to above preferred embodiment of the present invention.

Referring to FIG. 1, FIG. 2 and FIG. 3 of the drawings, a tunnel-type sterilizer and dryer oven device according to a preferred embodiment of the present invention includes a case body 1, an air intake cavity 24, a conveyor belt 7 and an air return channel 22 provided in the case body 1. The conveyor belt 7 is positioned between the air return channel 22 and the air intake cavity 24. The oven device comprises one or more air intake partition boards 11 in the air intake cavity 24 to divide the air intake cavity 24 into two or more independent air intake chambers 21, wherein each the air intake chamber 21 comprises a heater 9, and a hot air generator 2, a diffuser fan cover 3, a high temperature high efficiency filter 4 and a temperature probe 5 sequentially provided from a top portion to a bottom portion of the air intake chamber 21, wherein an air return partition board 15 is provided in the air return channel 22 at a position corresponding to a position of the air intake partition board 11 such that the air return channel 22 is divided into two or more air return chamber 23, wherein an air exit end of each the air return chamber 23 is positioned at a bottom end of the heater 9. Each of the air return chamber 23 comprises one or more air return chamber partition board 8 which divides the air return chamber 23 into two or more air return passage, wherein an exit end of each the air return passage is positioned at the bottom end of the heater 9. The case body 1 has an exterior surface and a heat retaining layer 26 on the exterior surface of the case body 1, wherein the heat retaining layer 26 has an opening 25 serving as a supplemental air inlet. Referring to FIG. 2 of the drawings, according to the preferred embodiment of the present invention, the air intake partition boards 11 divides the air intake cavity 24 into three sections, and the air return partition board 15 is provided in the air return channel 22 to divide the air return channel 22 into three air return chamber 23. The work area of the oven device is open and communicative to all sections, therefore if the air flow of each section is controlled to flow from the top to the bottom portion inside the cavity of the oven device, the temperature of air flow of the entire cavity of the oven device can be controlled through controlling each particular section and the temperature control of laminar flow of the air in the relatively partitioned cavities and chambers of each particular section. Accordingly, the temperature along the longitudinal axis of the oven device is more uniform.

The driving force of the hot air circulation in each air intake chamber 21 is originated from the hot air generator 2. The hot air from the air being heated by the heater 9 is sucked into the hot air generator 2 to blow towards the diffuser fan cover 3 (the direction of hot air flow is indicated by the arrows in the drawings figures), then the diffuser fan cover 3 diffuses the hot air from the hot air generator 2 such that the pressure of the hot air flow inside the diffuser fan cover 3 is relatively uniform. The hot air passes through the high temperature high efficiency filter 4 for filtering and flows out of the filter. Then, the hot air passes through the temperature probe 5 and is guided to flow to the conveyor belt 7 to reach bottles 6 on the conveyor belt 7 for heat exchange. As the temperature of the hot air is decreased and the temperature of the bottles 6 is increased, the bottles are transported to the case body 1 through the conveyor belt 7. The hot air then passes through the air return channel 22 and returns to the heater 9 through the air return chamber partition board 8 and is circulated continuously. Since the case body 1 has opening at two ends, some of the hot air which is of higher temperature will flow outside. Therefore, a supplemental air inlet 25 is provided at the air return channel 22 of each of the air intake chamber 21. The control method involves detecting the temperature of the hot air in each air intake chamber 21 through the temperature probe 5 and feeding the data to a control element such that the control element can control the amount of heat given by each of the heaters 9 so as to control the hot air temperature through the hot air passing through each particular heater 9. If the temperature detected by the temperature probe 5 is lower than a default value, the control element will increase the amount of heat given by the heater 9 such that the temperature of hot air passing through the heater 9 will be increased and the temperature of hot air passing into the air intake cavity 24 will then be increased accordingly. Similarly, the temperature of hot air in the air intake cavity 24 can be decreased by decreasing the heat emission from the heater 9.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An oven device of a tunnel-type sterilizer and dryer which includes a case body (1), an air intake cavity (24), a conveyor belt (7) and an air return channel (22) provided in the case body (1), wherein the conveyor belt (7) is positioned between the air return channel (22) and the air intake cavity (24), which is characterized in that: said oven device comprises one or more air intake partition boards (11) in the air intake cavity (24) to divide the air intake cavity (24) into two or more independent air intake chambers (21), wherein each said air intake chamber (21) comprises a heater (9), and a hot air generator (2), a diffuser fan cover (3), a high temperature high efficiency filter (4) and a temperature probe (5) sequentially provided from a top portion to a bottom portion of said air intake chamber (21), wherein an air return partition board (15) is provided in the air return channel (22) at a position corresponding to a position of said air intake partition board (11) such that the air return channel (22) is divided into two or more air return chamber (23), wherein an air exit end of each said air return chamber (23) is positioned at a bottom end of said heater (9).

2. The oven device of a tunnel-type sterilizer and dryer, as recited in claim 1, wherein each said air return chamber (23) comprises one or more air return chamber partition board (8) which divides said air return chamber (23) into two or more air return passage, wherein an exit end of each said air return passage is positioned at said bottom end of said heater (9).

3. The oven device of a tunnel-type sterilizer and dryer, as recited in claim 1, wherein said case body (1) has an exterior surface and a heat retaining layer (26) on the exterior surface of said case body (1), wherein said heat retaining layer (26) has an opening (25) serving as a supplemental air inlet.

4. The oven device of a tunnel-type sterilizer and dryer, as recited in claim 2, wherein said case body (1) has an exterior surface and a heat retaining layer (26) on the exterior surface of said case body (1), wherein said heat retaining layer (26) has an opening (25) serving as a supplemental air inlet.

* * * * *